US006502878B1

(12) United States Patent
Peters et al.

(10) Patent No.: US 6,502,878 B1
(45) Date of Patent: Jan. 7, 2003

(54) LIFTING DEVICE FOR LAYERS OF TRAY STACKS

(75) Inventors: Johannes Aloysius M. Peters, Brummen (NL); Freerk Dirk Slagman, Veenendaal (NL); Adrianus van Pinxteren, Eemnes (NL)

(73) Assignee: FPS Food Processing Systems B.V. (NL)

( * ) Notice: Subject to any disclaimer, the term of this patent is extended or adjusted under 35 U.S.C. 154(b) by 0 days.

(21) Appl. No.: 09/958,485

(22) PCT Filed: Apr. 14, 2000

(86) PCT No.: PCT/NL00/00242

§ 371 (c)(1),
(2), (4) Date: Dec. 11, 2001

(87) PCT Pub. No.: WO00/61487

PCT Pub. Date: Oct. 19, 2000

(30) Foreign Application Priority Data

Apr. 14, 1999 (EP) ..... 99201110
Aug. 24, 1999 (EP) ..... 99202719

(51) Int. Cl.[7] ..... B66C 1/24

(52) U.S. Cl. ..... 294/67.2; 294/67.5; 414/668; 414/785

(58) Field of Search ..... 294/67.1, 67.2, 294/67.21, 67.3, 67.31, 67.5, 81.1, 81.2, 81.51; 414/620, 662, 664, 668, 785; 901/45

(56) References Cited

U.S. PATENT DOCUMENTS 3,414,150 A * 12/1968 Ulinski ..... 254/122
4,024,973 A * 5/1977 Siderits et al. ..... 187/222
6,062,620 A * 5/2000 Walker et al. ..... 294/67.31

FOREIGN PATENT DOCUMENTS

DE 3840748 * 6/1990
DE 19539947 * 4/1997
FR 2305385 * 10/1976

* cited by examiner

*Primary Examiner*—Dean J. Kramer
(74) *Attorney, Agent, or Firm*—Larson & Taylor, PLC

(57) ABSTRACT

A lifting device comprising: a substantially horizontally extending support forming a support surface, comprising at least two support elements, such as, for instance, two prongs of a fork, for supporting a stack, a lifting member, movably connected to the support elements and displaceable in a vertical plane, a connecting device for movably connecting the support elements to the lifting member. The connecting device comprises: first members for, during picking up or putting down of the stack, moving a support element freely relative to the lifting member through an at least small distance relative to the lifting member in substantially vertical, upward direction; second members for freely rotating a support element through an at least small angle about an axis perpendicular to the vertical plane, the second members allowing free rotation only when, during picking up or putting down of the stack, the support element has been moved upwardly.

7 Claims, 5 Drawing Sheets

LIFTING DEVICE FOR LAYERS OF TRAY STACKS

The present invention related to a lifting device for displacing a stack of goods, a pack, or a load, comprising:

a substantially horizontally extending support forming a support surface, comprising at least two support elements each moveable in a first respective vertical plane, such as, for instance, two prongs of a fork, for supporting the stack during picking up, transporting, and putting down of the stack, the support elements during picking up being slid under the stack at one of the sides of the stack and during putting down being pulled from under the stack at said side;

a lifting member, movable connected to the support elements and displaceable in a second vertical plane, and a connecting device for movably connecting the support elements to the lifting member.

For transporting sorted products such as eggs, vegetables or fruits, trays are typically used. These trays are manufactured from flexible material so as not to damage these products. Moreover, with this material, any desired shape can be provided very suitably. The channels thus provided therein between the nests and the edges at the lateral sides also enable stacking such trays in an advantageous manner, there being generally formed stacks of six trays. Moreover, the prongs can readily be passed into the channels in order to lift one or more trays.

A drawback is that situations may occur in which less regular towers of stacks are formed, i.e. towers which are not entirely vertical. This may occur both during stacking as well as after some time, when, for instance, moisture may cause parts of the trays to sag.

These circumstances render it problematic to pick up such stacks and also to transfer them on top of each other. This last may, for instance, be the case during the loading of pallets.

The use of forks for transporting stacks is generally known. More in particular, the displacement of obliquely positioned stacks, especially of loaded pallets, is known from DE 2935553. In this document, a fork lifting device is shown of which each of the prongs which compose a fork and are fixedly horizontally directed, is insertable in such a manner that obliquely positioned pallets can also be picked up and put down, obliquely if necessary. To that end, each prong-bearing arm is connected to a corresponding vertical lifting guide in such a manner that over a well-defined vertical range, generally not too large, the insertion height will, during insertion, be assumed in an advantageous manner without obstruction. In particular, the hook-shaped construction of prong and arm is coupled to said lifting guide according to a parallelogram connection. Moreover, there is provided a biasing force which, during displacement of a prong from its stop position or rest position, drives back this loaded prong slightly and, in unloaded condition, largely compensates the weight of the construction itself. In this manner, in the case of obliquely positioned pallets, the prongs, inserted at staggered heights, are for instance pushed against one of the layers of the pallet platform, after which the lifting can take place in a reliable manner.

Such prongs fall short for picking up and putting down trays. During picking up and putting down stacks of trays respectively from and on stacks of trays disposed therebelow not entirely vertically, the prongs, which remain horizontal and are suitable for displacing constructions which remain substantially rigid, such as pallets, will lead to unstable insertion, sliding off and pulling away of the prongs. Due to this, stacks may get out of plumb and, consequently, even fall over.

To overcome this problem during picking up or putting down trays, the device according to the invention is characterized in that the connecting device comprises:

first members for, during picking up or putting down of the stack, moving a support element freely relative to the lifting member through an at least small distance relative to the lifting member in substantially vertical, upward direction;

second members for freely rotating a support element through an at least small angle about an axis perpendicular to said first respective vertical plane, the second members allowing free rotation only when, during picking up or putting down of the stack, the support element has been moved in said upward direction.

With such device, it is advantageously achieved that during picking up or putting down a stack from or on top of a stack which is positioned not entirely perpendicularly, one or more support elements or prongs abut against the support surface then present, so that no forced pushing of stacks or insertion or pulling away of prongs takes place and new towers of stacks do not become further unstable thereby. A further advantage is that in the case of trays filled with fragile products such as eggs, fruits or vegetables, they are not damaged.

In a further exemplary embodiment of the present invention, the lifting device is characterized in that the members comprise two sliding pins, arranged one above the other, and a sliding slot, such that during picking up or putting down of the stack, the movements of the pins are guided in the sliding slot, while for movements in upward direction there is provided a straight slot, and for rotation there is formed a slot which slightly diverges upwards.

With this combination of pins and slot, a free movement both in upward direction and in direction of rotation is readily effected. During picking up stacks of trays, the prongs will easily be able to adjust themselves to the channels, while during putting down of a stack, the support elements or prongs can be pulled away without resistance, whereupon they will slide back into the rest position or stop position by their own weight.

Hereinafter, the invention will be explained in more detail with reference to the accompanying drawings, wherein FIG. 1 represents a general, perspective view of the lifting device;

FIG. 2 more in particular shows the lifting device according to the present invention in a section taken on line I—I in FIG. 1 along the vertical plane in which the displacements take place;

Figure 1:
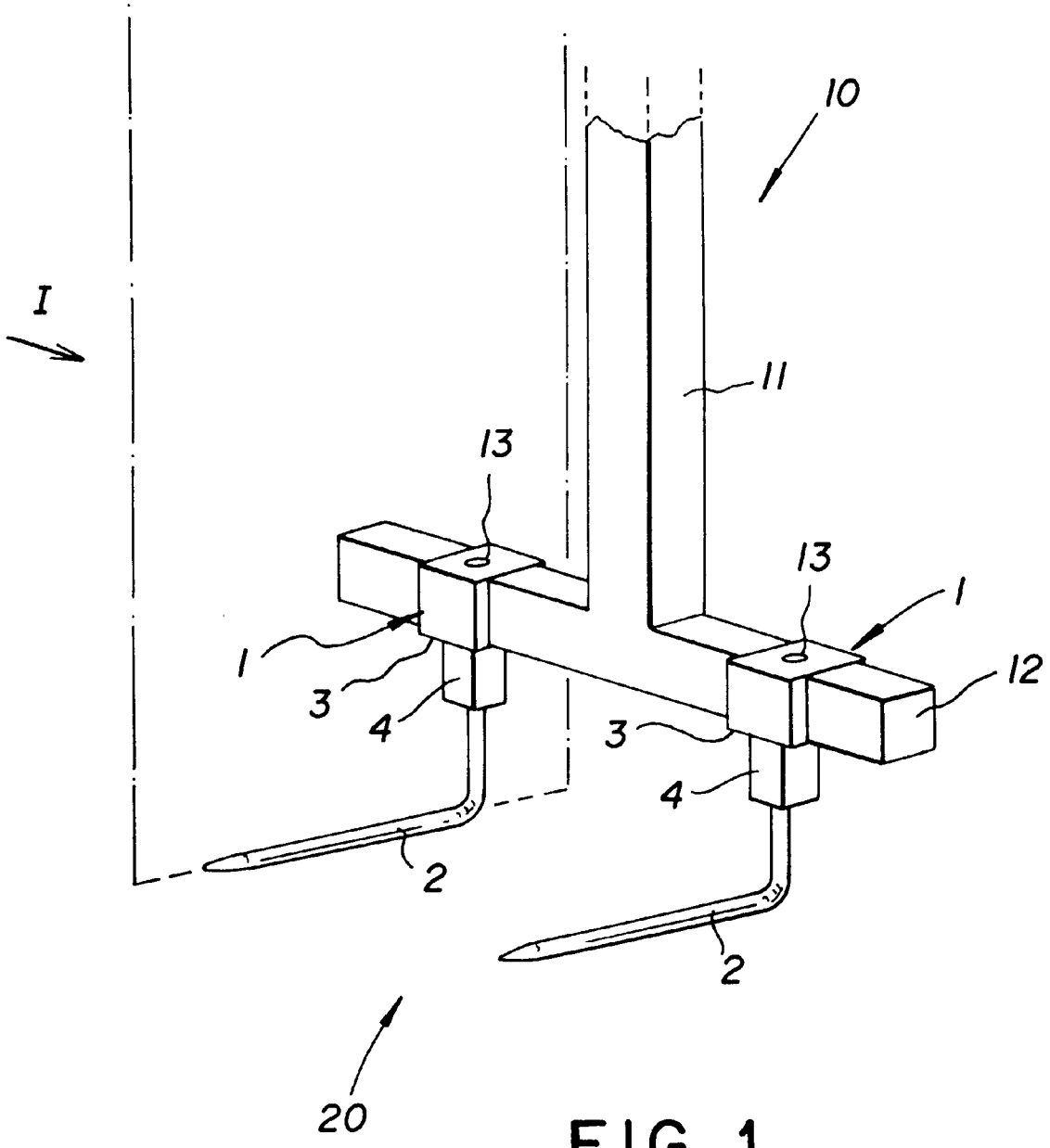

FIG. 1 is a perspective view of a part of a lifting device 10, in particular a vertical lifting member 11 with support bar 12, on which connecting devices 1 are mounted by means of, for instance, adjusting screws 13. By means of a mounting block 4, such connecting device 1, comprising a housing 3, provides a movable connection for support elements 2. The support elements or prongs 2 constitute a support surface, in particular a fork 20, whereby stacks or loads can be displaced upwards or downwards upon movement of lifting device 11.

Figure 2:
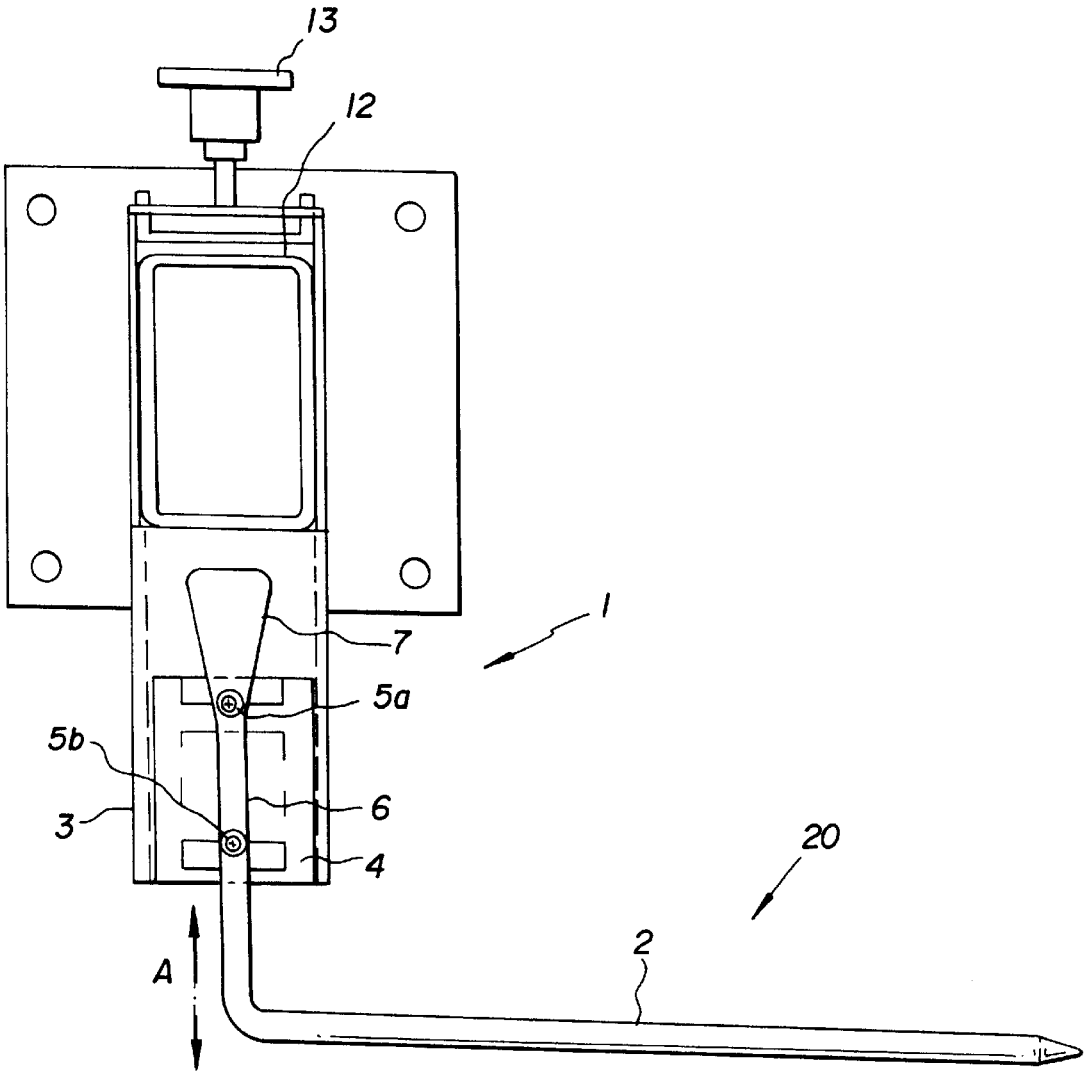

FIG. 2 shows in more detail the connecting device according to the invention. It presents a view in the indicated direction I of a section according to a vertical plane in which the generally substantially vertical movements of the fork 20, and in particular of a single support element or prong 2, take place according to the arrow A indicated.

Mounted on the support 12 is a connecting device 1. Located in the housing 3 of said connecting device is a guide passage for support 12, so that the housing 3 can be slid over it and fixed at the desired width distance by the adjusting screw 13. At the bottom side hereof, the support element or the prong 2 is suspended by its vertical portion in the mounting block 4, FIG. 2 showing the rest position or stop position for such prong 2. Arranged on this vertical portion are two guide pins, an upper guide pin 5*a* and a lower guide pin 5*b*. As FIG. 2 shows, these pins 5*a*, 5*b* are arranged so as to be directed perpendicularly to said vertical plane. Provided in the housing 4 is a sliding slot having a vertical part 6 and an upwardly widening or diverging part 7. The pins 5*a*, 5*b* are dimensioned so that they can slide up and down freely in this sliding slot. In addition, upon sliding upwards, the pin 5*a* will end up in part 7 and be able to rotate or tilt leftwards or rightwards, depending on the direction of pushing. The angle of rotation or tilting is defined by the degree of divergence of part 7 in cooperation with the dimensions of the upper pin 5*a*.

In the situation shown, the prong 2 is suspended in its lowest position, the stop position, or the rest position. Moreover, it is indicated that part 7 is not symmetrical, i.e. in this elevation, the widening on the left-hand side starts earlier than on the right-hand side. This has the advantage that as soon as the tip of the prong 2 contacts a surface during pushing up, the pins will not rack in the sliding slot, since the widening starts at the level of pin 5*a* and the prong 2 will start tilting immediately. When the prongs are not loaded, they will tilt rightwards, under their own weight, against the right-hand part, ending at a slightly higher position, of the straight part 6.

With reference to the Figures and the above specification, the operation, for instance during putting down, can readily be understood as follows.

When a stack sits on a fork, the prongs 2 will be in their lowermost position, which position is assumed due to the fact that the prongs are pushed down in the slots through the weight of substantially this stack. As soon as the stack is to be placed on a next stack, the ends of the prongs 2 will slightly rise during putting down and, in the drawn example according to FIG. 2, be able to rotate leftwards. If the subjacent stack of trays stands substantially perpendicularly, the trays placed on top of it will positioned with a precise fit by their edges, after which the prongs 2 can be pulled away from under it horizontally. By their own weight, the prongs will slide back into their rest position or stop position as shown in FIG. 2.

On the other hand, when the subjacent stack does not stand entirely horizontally, for instance 5° out of plumb, the ends of the prongs 2 will, upon putting down, be able to move slightly upwards first and, moreover, tilt in the direction allowed. This free rotation in part 7 of the sliding slot enables the prongs, and accordingly the stack, to adjust themselves to the direction of the oblique top surface of the subjacent stack. In that case, too, the trays will be fittingly positioned by their edges, whereupon the prongs of the fork can be pulled away without obstruction and without causing any further damage.

It will be understood by anyone skilled in the art that the dimensioning of the sliding slot can be selected as desired. Thus, FIG. 2 shows that part 7 is not entirely symmetrical, while the angle of divergence, calculated relative to the axis of the vertical part of the prong, is about 20°. Preferably, the height of part 6 of the control slot is a few centimeters, while the angle of divergence of part 7 is not greater than 40°, preferably not greater than 20°.

Figure 3:
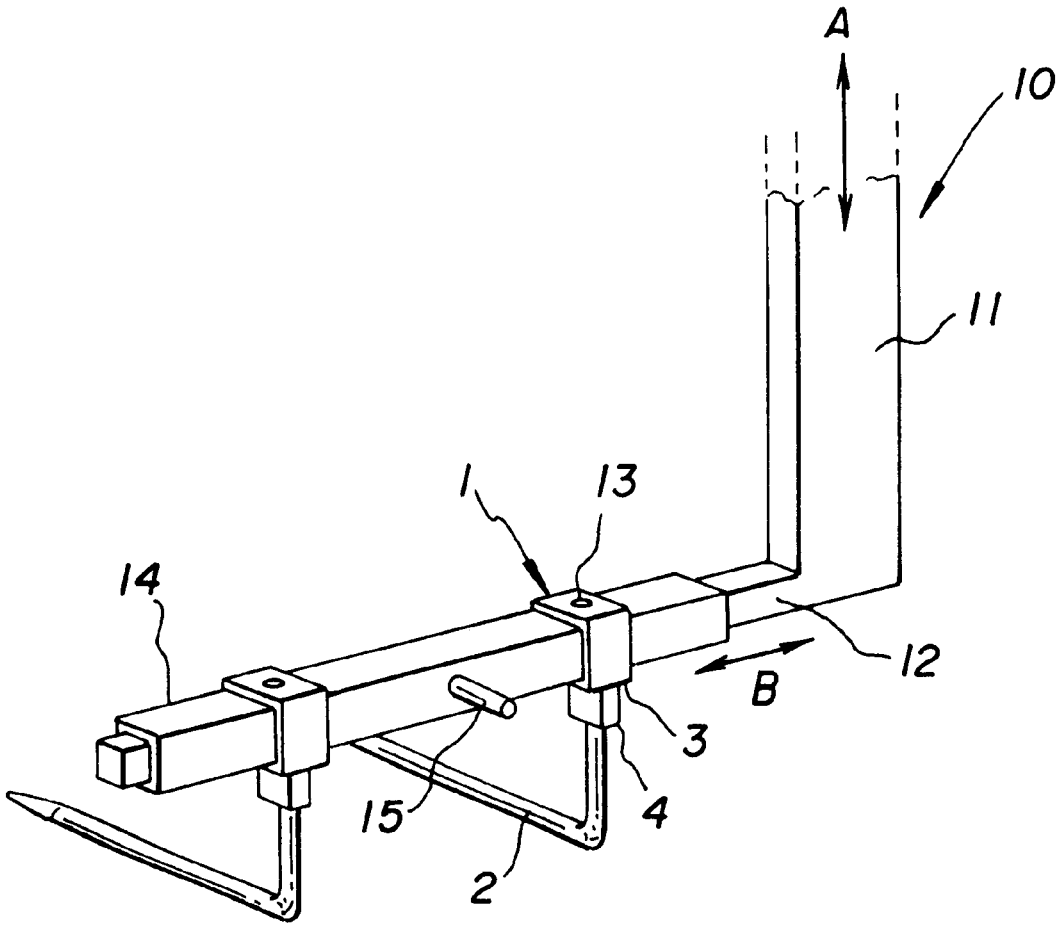
FIG. 3 is a perspective view of a second exemplary embodiment.

In a further exemplary embodiment as drawn in FIG. 3, instead of being mounted on support 12 by adjusting screws, the housings 3 are now provided on a support or tube 14 which is telescopically slidable over support 12. Now, too, the housings may each be separately mounted on such tube. During sliding of this tube 14, the effect achieved is that, when fixed mutual distances between the housings and hence between the prongs 2 are maintained, the insertion position of each prong 2 is shifted accordingly. It has been found that this is very suitable for stacking and unstacking trays, or stacks of trays, for eggs. It is customary to form stacks of six trays.

Figure 5:
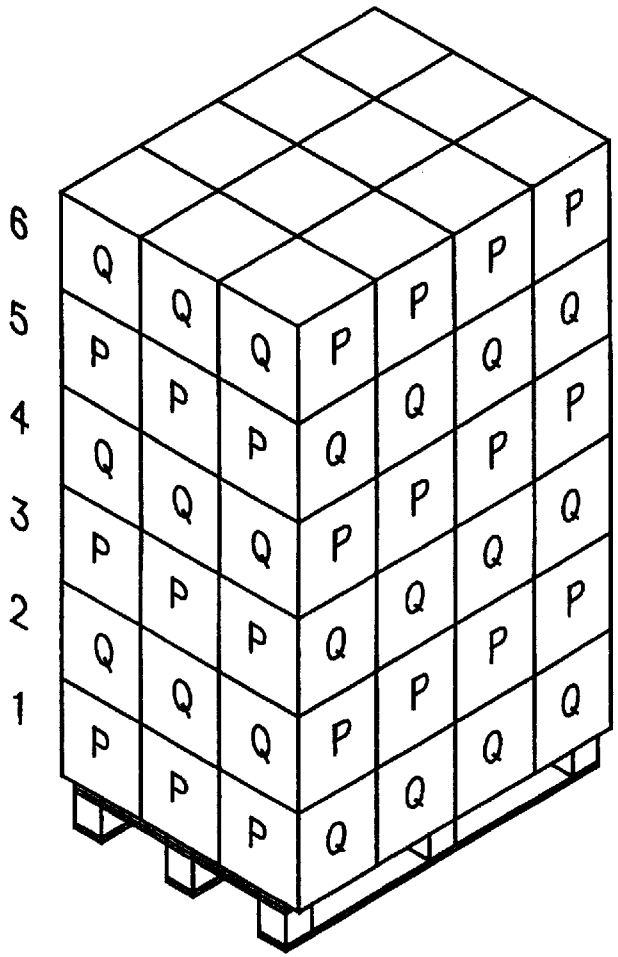
FIG. 5 shows a pallet with differently oriented layers of stacks of trays.
Figure 4:
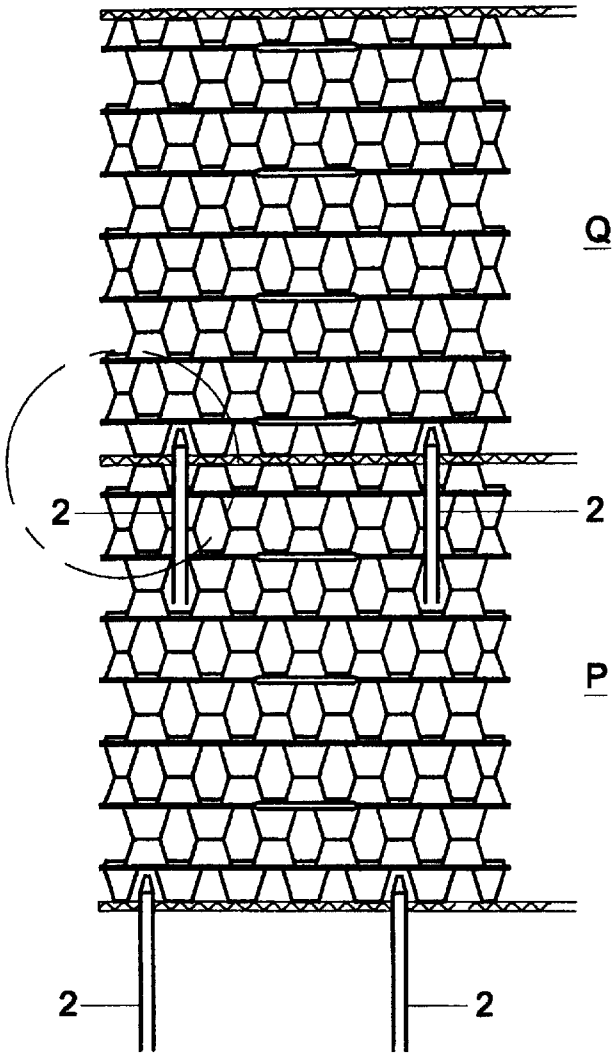
FIG. 4 is a side elevation of two differently oriented stacks.
Figure 7:
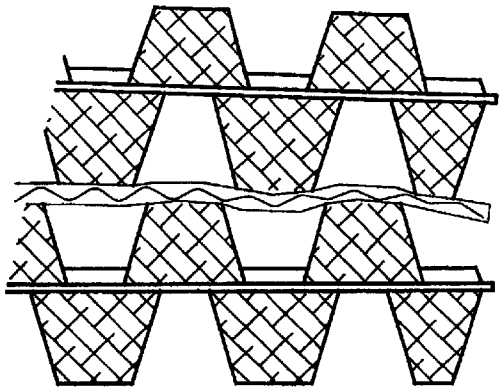
FIG. 7 shows a detail of FIG. 6.
Figure 8:
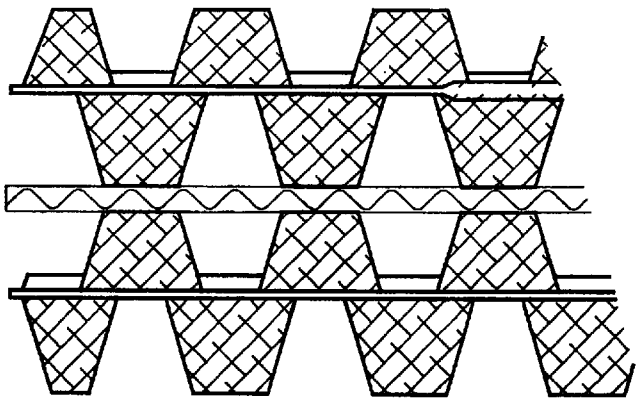
FIG. 8 shows a detail of FIG. 4.
Figure 6:
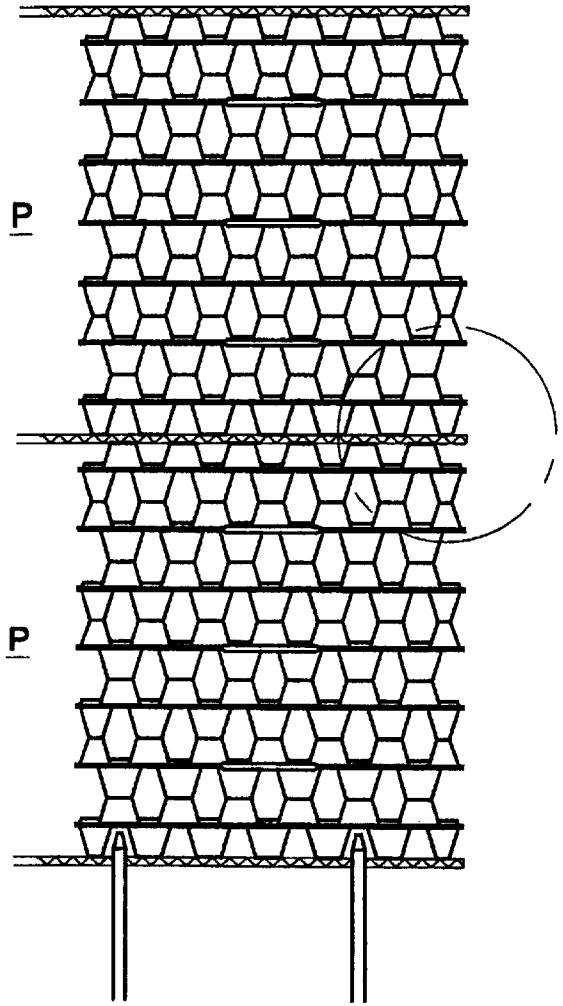
FIG. 6 is a side elevation of two equally oriented stacks.

These trays have a rectangular or square shape. In side elevation, the trays have two different lateral sides, as shown in FIG. 4. On the so-called P-side, the product nests of the trays are located in a position different from those on the so-called Q-side. Within a stack of trays, which stack usually consists of six trays stacked on top of each other, the trays usually have the same orientation. From a particular side view, such stack is referred to as P-stack or Q-stack. A number of stacks side by side form a layer. Depending on the orientation of the stacks in a layer, a layer is referred to as PQP-layer, PPP-layer or QQQ layer. FIG. 5 shows a pallet on which six layers of stacks are disposed, with a PPP-layer and a QQQ-layer being alternately arranged. Such stacking yields a great stability. Often, a layer of stacks is further covered by a non-filled tray, a so-called covering tray, and by a sheet, typically from corrugated board, functioning as intermediate sheet to provide the layers of stacks with more firmness. The alternate arrangement of PPP-layers and QQQ-layers or the alternate arrangement of PQP-layers on QPQ-layers, does not only result in a highly stable stacking of stacks of trays, but also suitably prevents deflection of the intermediate sheets. The deflection of an intermediate sheet during the stacking of two equally oriented stacks is shown in FIG. 7, which shows a detail of a stacking of two equally oriented P-layers of FIG. 6. FIG. 8 shows a detail of FIG. 4, where two differently oriented layers are stacked onto each other. In FIG. 8, it is clearly visible that the intermediate sheet hardly deflects, if at all, as opposed to what is shown in FIG. 7. Due to the above-described different lateral sides of the trays, when a P-stack of trays is to be picked up, the pins 2 of the support will have to adopt a position different from when a Q-stack of trays is to be picked up. These different positions of the pins are clearly shown in FIG. 4.

For creating or unstacking stacks layered in such manner, the present telescopically slidable tube 14 is of great advantage.

Displacing the tube 14 over support 12 can advantageously be performed by means of a pin 15 mounted on the tube. For instance, each time when a "stack P" is followed by a "stack Q", or the other way round, the pin 15 can be passed through a positioning slot enabling the pin to make a lateral displacement. It will be understood by anyone skilled in the art that plates of suitably designed slot patterns can be used for this purpose, for instance provided on a lateral side of a lifting station of which the lifting device forms a part. This operation can be performed through automated control. Of course, the tube can also be displaced manually, or manners of displacing the tube 14 other than by the pin 15 shown can be followed. Moreover, means may be provided whereby, for displacement, some friction has to be overcome, so as to keep the tube in position during lifting operations.

Further, the invention may be provided with sensors capable of detecting heights and angles so that both in the case of manual operation and in the case of automatic control, warning signals and corresponding control can be provided when heights or angles get outside an allowed and set range.

It will be understood by anyone skilled in the art that minor changes are considered to fall within the scope of the present invention, as defined in the claims attached hereto.

What is claimed is:

1. A lifting device for displacing a stack of goods, a pack, or a load, comprising:

a substantially horizontally extending support forming a support surface, comprising at least two support elements each moveable in a first respective vertical plane for supporting the stack during picking up, transporting, and putting down of the stack, the support elements during picking up being slid under the stack at one of the sides of the stack and during putting down being pulled from under the stack at said side;

a lifting member, movably connected to the support elements and displaceable in, a second vertical plane, and a connecting device for movably connecting the support elements to the lifting member, the connecting device comprising:

first members for, during picking up or putting down of the stack, moving a support element freely relative to the lifting member through an at least small distance relative to the lifting member in substantially vertical, upward direction;

and second members for freely rotating a support element through an at least small angle about an axis perpendicular to said first respective vertical plane, the second members allowing free rotation only when, during picking up or putting down of the stack, the support element has been moved in said upward direction.

2. A lifting device according to claim 1, wherein the members comprise two sliding pins, arranged one above the other, and a sliding slot, such that during picking up or putting down of the stack, the movements of the pins are guided in the sliding slot, while for movements in upward direction there is provided a straight slot, and for rotation there is formed a slot which slightly diverges upwards.

3. A lifting device according to claim 2, wherein the angle of divergence of the diverging slot, calculated relative to the vertical direction, ranges between 0° and 20°.

4. A lifting device according to claim 3, wherein the slots are provided in a housing mounted on a support of the lifting member.

5. A lifting device according to claim 4, wherein a housing is mounted on a tube displaceable over the support.

6. A lifting device according to claim 5, wherein a pin is mounted on the tube, said pin providing a lateral displacement of the tube over the support during sliding through a positioning slot.

7. A lifting device according to claim 1, wherein the support elements comprise two prongs of a fork.

* * * * *